US005211835A

United States Patent [19]

Forester

[11] Patent Number: 5,211,835

[45] Date of Patent: May 18, 1993

[54] USE OF REACTION PRODUCTS OF PARTIALLY GLYCOLATED POLYALKENYL SUCCINIMIDES AND DIISOCYANATES AS ANTIFOULANTS IN HYDROCARBON PROCESS MEDIA

[75] Inventor: David R. Forester, Conroe, Tex.

[73] Assignee: Betz Laboratories, Inc., Trevose, Pa.

[21] Appl. No.: 848,785

[22] Filed: Mar. 10, 1992

[51] Int. Cl.[5] ..... C10G 9/16

[52] U.S. Cl. ..... 208/48 AA; 208/48 R; 585/950

[58] Field of Search ..... 208/48 AA, 48 R; 252/515 A

[56] References Cited

U.S. PATENT DOCUMENTS 3,235,484 2/1966 Colfer ..... 208/48
4,578,178 3/1986 Forester ..... 208/48
4,713,191 12/1987 Nalesnik ..... 252/51.5 A
4,775,459 12/1988 Forester ..... 208/48
4,883,886 11/1989 Huang ..... 549/255

*Primary Examiner*—Theodore Morris
*Assistant Examiner*—Walter D. Griffin
*Attorney, Agent, or Firm*—Alexander D. Ricci; Richard A. Paikoff

[57] ABSTRACT

Partially glycolated polyalkenylsuccinimide-diisocyanate reaction products are used as effective antifoulants in liquid hydrocarbonaceous mediums, such as crude oils and gas oils, during processing of such liquids at elevated temperatures. The reaction products are formed via a three-step reaction in which a polyalkenylsuccinic anhydride precursor is reacted with an amine to form polyalkenylsuccinimide intermediate which, in turn, is reacted with glycolic acid to form a partially glycolated bis-alkenyl succinimide, followed by adding a diisocyanate to the succinimide.

12 Claims, No Drawings

USE OF REACTION PRODUCTS OF PARTIALLY GLYCOLATED POLYALKENYL SUCCINIMIDES AND DIISOCYANATES AS ANTIFOULANTS IN HYDROCARBON PROCESS MEDIA

FIELD OF THE INVENTION

The present invention pertains to the use of reaction products of partially glycolated polyalkenyl succinimides and diisocyanates to inhibit fouling in liquid hydrocarbon mediums during the heat treatment processing of the medium, such as in refinery processes.

BACKGROUND OF THE INVENTION

In the processing of petroleum hydrocarbons and feed stocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200°-550° C. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, reaction products of partially glycolated polyalkenyl succinimides and diisocyanates are used to inhibit fouling of heated liquid hydrocarbon mediums. Typically, such antifoulant protection is provided during heat processing of the medium, such as in refinery, purification, or production processes.

The reaction products are formed via a three-step reaction. In the first step, a polyalkenyl succinic anhydride is reacted with an amine, preferably a polyamine, such as a polyethyleneamine, in order to form a polyalkenylsuccinimide intermediate. The intermediate is then reacted with enough glycolic acid to acylate all of the free basic amines except for one or one equivalent amine to form a partially glycolated bis-alkenyl succinimide. A diisocyanate is then added to the succinimide to form the desired reaction product.

PRIOR ART

U.S. Pat. No. 4,713,191 describes the reaction products of polyalkenylsuccinimides with glycolic acid, then subsequently reacted with a diisocyanate. These products function as dispersants and viton seal additives when added to lubricating oils and tested in automotive engines. In contrast, the present invention calls for inhibition of fouling in liquid hydrocarbonaceous mediums during the high temperature processing of the medium. Studies have indicated that many compounds known to be useful as lubricating oil detergent-dispersants do not adequately function as process antifoulants during heat treatment processing of the treated medium.

One particularly successful group of antifoulants is reported in U.S. Pat. No. 4,578,178 (Forester - common assignment herewith). This patent discloses the use of polyalkenylthio phosphonic acid esters as antifoulants in heat treated hydrocarbon mediums with the Group II(a) cation salts of such acids being specified in U.S. Pat. No. 4,775,459 (Forester - of common assignment herewith).

DETAILED DESCRIPTION

I have found that the reaction products of partially glycolated polyalkenyl succinimides with diisocyanates provide significant antifoulant efficacy in liquid hydrocarbonaceous mediums during the high temperature treatment of the medium.

It is to be understood that the phrase "liquid hydrocarbonaceous medium" as used herein signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residua, etc., are all included in the definition.

Similarly, petrochemieals such as olefinic or naphthenic process streams, aromatic hydrocarbons and their derivatives, ethylene dichloride, and ethylene glycol are all considered to be within the ambit of the phrase "liquid hydrocarbonaceous mediums".

The reaction products useful in the invention are generally prepared via a three-step reaction. In the first step, a polyalkenylsuccinic anhydride is reacted with a polyamine, preferably a polyethyleneamine, to form the desired polyalkenylsuccinimide. Then, the polyalkenylsuccinimide is reacted with enough glycolic acid to acylate all of the free basic amines except for one or one equivalent amine to form a partially glycolated bis-alkenyl succinimide. A diisocyanate is then added to the succinimide to form the desired reaction product.

More specifically, the starting reactant, polyalkenylsuccinic anhydride may be purchased commercially or prepared. Presently, it is preferred to buy this from Texaco. One such commercially sold polyalkenylsuccinic anhydride is sold under the trademark TLA-627. It is a polyisobutenylsuccinic anhydride (PIBSA) having the structure

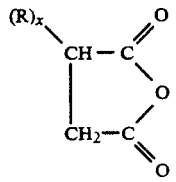

(I)

wherein, in this case, R is an isobutenyl repeat unit. The average molecular weight of the polyisobutene used to produce the PIBSA is about 1300.

The precursor polyalkenylsuccinic anhydride may also be prepared as reported in U.S. Pat. No. 3,235,484 (Colfer), incorporated herein by reference or, more preferably, by the methods reported in U.S. Pat. No. 4,883,886 (Huang) also incorporated by reference herein. As to the Colfer method, the anhydrides may be prepared by reaction of maleic anhydride with a high molecular weight olefin or a chlorinated high molecular weight olefin. In the preferred Huang method, reaction of a polymer of a $C_2$–$C_8$ olefin and maleic anhydride are carried out in the presence of a tar and side product suppressing agent.

The most commonly used sources for forming the aliphatic R substituent on the succinic anhydride compound (I) are the polyolefins, such as polyethylene, polypropylene, polyisobutene, polyamylene, polyisohexylene, etc. The most particularly preferred polyolefin (and the one used to manufacture the polyisobutenylsuccinic anhydride from Texaco) is polyisobutene. As Colfer states, particular preference is made for such a polyisobutene-containing at least about 50 carbon atoms, preferably from at least 60 carbon atoms and most desirably from about 100 to about 150 carbon atoms. Accordingly, an operable carbon atom number range for R is from about 30–200 carbon atoms.

Once the polyalkenylsuccinic anhydride precursor is obtained, it is reacted with a polyamine, as reported in Colfer, at temperature in excess of about 80° C. so as to form an imide. More specifically, the polyalkenylsuccinic anhydride

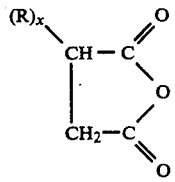

(I)

wherein R is an aliphatic alkenyl or alkyl moiety having at least about 50 carbon atoms and less than about 200 carbon atoms, is reacted with a polyamine having the structure

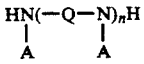

(II)

in which n is an integer, A is chosen from hydrocarbyl, hydroxy alkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is ($C_1$–$C_5$) alkylene, such as ethylene, trimethylene, tetramethylene, etc. Q is most preferably ethylene.

Accordingly, exemplary amine components may comprise ethylenediamine, triethylenetetramine, tetraethylenepentamine, diethylenetriamine, trimethylenediamine, bis(trimethylene) triamine, tris-(trimethylene)tetramine, tris(hexamethylene)tetramine, decamethylenediamine, N-octyltrimethylene diamine, N-(2-hydroxyethyl)ethylenediamine, 1-(2-aminopropyl) piperazine, 1,4-bis-(2-aminoethyl)piperazine, bis-(hydroxypropyl)substituted tetraethylenepentamine, N-3-(hydroxypropyl)tetramethylenediamine, 2-methylimidazoline, polymerized ethyleneimine, and 1,3-bis(2-aminoethyl)imidazoline.

The reaction of precursor polyalkenyl succinic anhydride with amine (II) is conducted at temperature in excess of 80° C. with use of a solvent, such as benzene, xylene, toluene, naphtha, mineral oil, n-hexane, etc. Preferably, the reaction is conducted at from 100°–250° C. with molar amount of precursor anhydride (I): amine (II) being from about 1:5 to about 5:1 with a molar amount of 1–3:1 being preferred.

The polyalkenylsuccinimide so obtained will have the structure

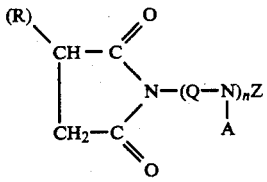

(III)

wherein R, Q, A and n are as previously defined in connection with structural formulae I and II. Z is either H or

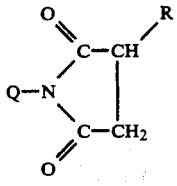

After the polyalkenylsuccinimide precursor has been obtained, it is reacted with glycolic acid as described in U.S. Pat. No. 4,713,191 (Nalesnik) to form the desired reaction product. A diisocyanate is then added to the succinimide to form a diurea coupled glycolated bis-alkenyl succinimide. At present, preliminary studies have indicated surprisingly effective antifouling inhibition results with the reaction product of the present invention. It is believed this product is formed from about a 2:1 molar ratio of polyisobutenyl succinic anhydride (mw isobutenyl moiety 1300) with a polyethyleneamine believed to be triethylenetetramine.

The reaction products useful in this invention may be added to or dispersed within the liquid hydrocarbonaceous medium in need of antifouling protection in an amount of 0.5–10,000 ppm based upon one million parts of the liquid hydrocarbonaceous medium. Preferably, the antifoulant is added in an amount of from 1 to 2500 ppm.

The reaction products may be dissolved in a polar or non-polar organic solvent, such as heavy aromatic naphtha, toluene, xylene, or mineral oil and fed to the requisite hot process fluid or they can be fed neat thereto. These derivatives are especially effective when added to the liquid hydrocarbonaceous medium during the heat processing thereof at temperatures of from 100°–550° C.

EXAMPLES

The dual fouling apparatus (DFA), as described in U.S. Pat. No. 4,578,178, was used to determine the antifoulant efficacy of a reaction product of a polyalkenylsuccinimide with glycolic acid followed by diisocyanate in desalted crude oil as illustrated in Table 1. Furthermore, the antifoulant efficacy of a polyisobutenyl succinimide antifoulant was compared to this compound in desalted crude oil with results detailed in Table 1. This material is sold commercially as a dispersant additive for automotive lubricating oils.

A starting polyisobutenyl succinimide was prepared by reacting polyisobutenyl succinic anhydride (average molecular weight 1300 polyisobutene) with triethylenetetramine in a 2/1 mole ratio. The succinimide was reacted with glycolic acid according to Example I of the '191 patent, then subsequently reacted with diisocyanate to yield a 50% active product diluted with mineral oil. This material was designated PBSGD.

The DFA used to generate the data shown in Table I contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperature of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\% \text{ Protection} = \frac{\text{Avg. } \Delta\text{Area (control)} - \Delta\text{Area (Treatment)}}{\text{Avg. } \Delta\text{Area (control)}} \times 100$$

TABLE I

Summary of DFA Results on PBSGD Compared to Polyisobutenyl Succinimide Antifoulant (PIBSA Succinimide) Crude Oil D, 482° C. Rod Temperature

| Additive (ppm active) | | % Protection |
|---|---|---|
| PIBSA Succinimide | (62.5) | 8 (Avg.) |

TABLE I-continued

Summary of DFA Results on PBSGD Compared to Polyisobutenyl Succinimide Antifoulant (PIBSA Succinimide) Crude Oil D, 482° C. Rod Temperature

| Additive (ppm active) | | % Protection |
|---|---|---|
| | (250) | 18 |
| PBSGD | (62.5) | 11 (Avg.) |
| | (250) | 39 |

As shown in Table I, the PBSGD material exhibited antifoulant efficacy in crude oil and was better than PIBSA succinimide in inhibiting fouling of the tested liquid hydrocarbonaceous medium.

Another series of tests adapted to assess candidate efficacy in providing fouling inhibition during high temperature treatment of liquid hydrocarbon mediums were performed. These tests are titled the "Hot Filament Fouling Tests" and were run in conjunction with gas oil hydrocarbon mediums. The procedure for these tests involves the following:

Hot Filament Fouling Tests (HFFT)

A preweighed 24-gauge Ni-chrome wire is placed between two brass electrodes in a glass reaction jar and held in place by two brass screws. 200 mls of feedstock are measured and added into each sample jar. One sample jar is left untreated as a control with other jars being supplied with 125 ppm (active) of the candidate material. The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125°–50° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry.

Each wire and the resulting deposits thereon are weighed with the weight of the deposit being calculated. Photographs of the wires are taken comparing untreated, treated, and clean wires from each series of experiments using a given controller.

The deposit weight for a given wire was calculated in accordance with $$\text{wt. deposit} = \begin{pmatrix}\text{weight of wire} \\ \text{plus deposit}\end{pmatrix} - \text{(original wire weight)}$$

The percentage protection for each treatment sample was then calculated as follows:

$$\% \text{ protection} = \left[1 - \frac{\text{wt. deposit (treated)}}{\text{wt. deposit (untreated)}}\right] \times 100$$

Results are shown in Table II

TABLE II

Summary of HFFT Results on PBSGD Compared to PIBSA Succinimide

| Additive (ppm active) | | Feedstock | % Protection |
|---|---|---|---|
| PIBSA Succinimide | (125) | SRLGO | 40 (Avg.) |
| | (125) | CCLGO | 89 (Avg.) |
| PBSGD | (125) | SRLGO | 53 |
| | (125) | CCLGO | 88 |

In Table II, SRLGO means straight run light gas oil from a midwestern refinery with CCLGO indicating a catalytic cracked light gas oil from the same midwestern refinery. The PBSGD was somewhat better in antifoulant efficacy than the PIBSA succinimide in the SRLGO and approximately equivalent in antifoulant efficacy when tested in the CCLGO feedstock.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. A method of inhibiting fouling deposit formation in a liquid hydrocarbonaceous medium during heat treatment processing thereof at temperatures of from about 200° C.-550° C., wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of from about 0.5-10,000 parts per million of a reaction product of a polyalkenylsuccinimide having the formula

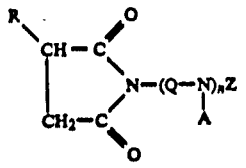

(III)

wherein R is an aliphatic alkenyl or alkyl moiety having at least about 50 carbon atoms and less than about 200 carbon atoms, Q is a divalent aliphatic radical, n is a positive integer, A is hydrocarbyl, hydroxyalkyl or hydrogen, Z is H or

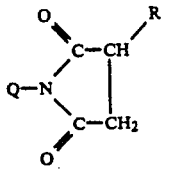

with glycolic acid to form a partially glycolated bis-alkenyl succinimide, followed by adding a diisocyanate to said partially glycolated bis-succinimide, said liquid hydrocarbonaceous medium comprising petroleum hydrocarbons or petrochemicals.

2. The method as recited in claim 1 wherein said liquid hydrocarbonaceous medium comprises crude oil, straight run light gas oil, or catalytically cracked light gas oil.

3. The method as recited in claim 1 wherein R comprises from about 50-150 carbon atoms and is a polyalkenyl moiety.

4. The method as recited in claim 3 wherein R comprises a repeated isobutenyl moiety.

5. The method as recited in claim 4 wherein Q is chosen from $C_1$-$C_5$ alkylene and A is hydrogen.

6. The method as recited in claim 5 wherein Q is ethylene.

7. The method as recited in claim 3 wherein R has a molecular weight of about 1300.

8. A method for inhibiting fouling deposit formation in a liquid hydrocarbonaceous medium during heat treatment processing thereof at temperatures of from about 200° C.-550° C. wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of from about 0.5-10,000 parts per million of an antifoulant reaction product, said antifoulant reaction product formed by first reaction of polyalkenylsucinic anhydride with a polyamine to form a polyalkenylsuccinimide intermediate, followed by a second stage reaction of said intermediate with glycolic acid to form a partially glycolated bis-alkenyl succinimide, followed by adding a diisocyanate to said partially glycolated bis-succinimide, thereby forming said antifoulant reaction product, said liquid hydrocarbonaceous medium comprising petroleum hydrocarbons or petrochemicals, and said polyamine comprising an ethylenepolyamine.

9. The method as recited in claim 8 wherein said polyamine comprises an ethylenepolyamine.

10. The method as recited in claim 9 wherein said ethylenepolyamine comprises triethylenetetramine.

11. The method as recited in claim 9 wherein in said first reaction said polyalkenylsuccinic anhydride is present in a molar amount of from about 0.2-5 moles based upon 1 mole of said ethylenepolyamine.

12. The method as recited in claim 9 wherein in said first reaction said polyalkenylsuccinic anhydride is present in a molar amount of from about 1-3 moles based upon 1 mole of said ethylenepolyamine.

* * * * *